US011338410B1

(12) United States Patent
Selle et al.

(10) Patent No.: US 11,338,410 B1
(45) Date of Patent: May 24, 2022

(54) DUST REMOVAL ASSEMBLY FOR USE WITH DISC GRINDER

(71) Applicant: SOTA Customs LLC, Center City, MN (US)

(72) Inventors: Anthony John Selle, Ogilvie, MN (US); Aaron Jay Olson, Center City, MN (US)

(73) Assignee: SOTA CUSTOMS LLC, Center City, MN (US)

( * ) Notice: Subject to any disclaimer, the term of this patent is extended or adjusted under 35 U.S.C. 154(b) by 495 days.

(21) Appl. No.: 16/460,124

(22) Filed: Jul. 2, 2019

Related U.S. Application Data

(60) Provisional application No. 62/693,149, filed on Jul. 2, 2018.

(51) Int. Cl.
*B24B 55/10* (2006.01)
*B24B 23/02* (2006.01)

(52) U.S. Cl.
CPC ..... *B24B 55/102* (2013.01); *B24B 23/02* (2013.01)

(58) Field of Classification Search
CPC ..... B24B 55/05; B24B 55/052; B24B 55/06; B24B 55/10; B24B 55/102; B24B 23/02; B24B 55/04
USPC ..... 451/451, 456, 358, 359
See application file for complete search history.

(56) References Cited

U.S. PATENT DOCUMENTS 1,042,618 A * 10/1912 Stone ..... B24B 55/06 451/456
1,145,189 A * 7/1915 Gardner et al. ..... B24B 55/02 451/450
1,217,996 A * 3/1917 Partridge ..... B24B 55/06 451/456
1,638,459 A * 8/1927 Ritz ..... B24B 55/04 451/451
1,827,270 A * 10/1931 Smith ..... B24B 55/04 451/456
2,345,958 A * 4/1944 Woodbury ..... B24B 55/06 451/456
2,618,916 A * 11/1952 Oftedal ..... B24B 55/06 451/456

(Continued)

FOREIGN PATENT DOCUMENTS

GB 2358152 A 7/2001
WO WO-2018010854 A1 * 1/2018 ..... B25F 5/02

*Primary Examiner* — Katina N. Henson
(74) *Attorney, Agent, or Firm* — DuFault Law Firm, P.C.; Dustin R. DuFault

(57) ABSTRACT

A dust removal assembly for use with a disc grinder includes a base portion with a member defining a major surface, a wall extending at least partially along an outer periphery of the major surface, an exhaust port contained within the wall, and a first ledge positioned proximate the exhaust port extending along the major surface. A top plate, attachable to the wall, includes a second ledge extending downward from a lateral edge toward the base portion such that the first ledge and the second ledge are positioned proximate to, and extend horizontally parallel to, one another. Both the first ledge and the second ledge are configured to permit a circular disc to travel therebetween. A compartment in fluid communication with an exhaust port is defined by the first ledge, the wall and a minor surface positioned below the major surface.

20 Claims, 7 Drawing Sheets

(56) References Cited

U.S. PATENT DOCUMENTS 2,715,799 A * 8/1955 Billeter ..... B24B 19/28 451/226
3,256,648 A 6/1966 Subonovich
3,468,076 A 9/1969 Jones
4,145,848 A 3/1979 Hutchins
4,192,104 A 3/1980 Patenaude
4,832,412 A 5/1989 Bertrand
5,033,192 A * 7/1991 Franz ..... B24B 55/102 30/124
5,084,972 A 2/1992 Waugh
5,125,190 A 6/1992 Buser et al.
5,411,433 A 5/1995 Keller
5,440,809 A * 8/1995 Padilla ..... B23Q 11/0046 30/124
5,791,979 A 8/1998 Duncan et al.
6,027,399 A 2/2000 Stewart
6,595,196 B2 7/2003 Bath
6,616,518 B2 9/2003 Sun et al.
6,648,742 B1 11/2003 Segiel Jr.
6,896,604 B1 5/2005 Taylor et al.
8,133,094 B2 3/2012 Loveless et al.
8,137,165 B2 3/2012 Loveless et al.
8,177,606 B2 5/2012 Loveless et al.
8,801,506 B2 8/2014 Chen
9,221,110 B2 12/2015 Guth
9,278,427 B2 3/2016 Numata
2003/0119436 A1 6/2003 Ohlendorf
2004/0157541 A1* 8/2004 Wendt ..... B24B 23/028 451/451
2005/0058518 A1 3/2005 Valentini
2008/0011138 A1 1/2008 Brazell et al.
2009/0183377 A1 7/2009 Loveless et al.
2009/0215364 A1* 8/2009 Sun ..... B24B 55/102 451/178
2010/0058911 A1 3/2010 Goddard
2010/0313867 A1 12/2010 Loveless
2019/0063011 A1 2/2019 Planavsky

* cited by examiner

DUST REMOVAL ASSEMBLY FOR USE WITH DISC GRINDER

CROSS-REFERENCE TO RELATED APPLICATION

The present application claims a benefit of similarly entitled U.S. Provisional Application No. 62/693,149 filed Jul. 2, 2018. The entirety of the foregoing application is hereby incorporated herein by reference.

BACKGROUND OF THE INVENTION

The present invention relates to dust removal devices for use with disc grinders. More particularly, the present invention relates to a device attachable to a hand-held disc grinder which facilitates in the removal of dust and debris created during use of the disc grinder, especially in connection with cutting mortar, concrete, stone or masonry.

A disc grinder, also known in the art as a side grinder or angle grinder, is a handheld power tool used for grinding and cutting substrate surfaces, including abrasive cutting and polishing. Although developed originally as tools for rigid abrasive discs, the availability of an interchangeable power source has encouraged their use with a wide variety of cutters and attachments. Disc grinders can be powered by an electric motor, gas engine, compressed air or hydraulic fluid. The motor drives a geared head at a right-angle on which is mounted an abrasive disc, saw blade or a thinner cut-off disc, either of which can be replaced when worn. Angle grinders typically have an adjustable guard and a side-handle for two-handed operation. Certain disc grinders, depending on their speed range, can be used as sanders, employing a sanding disc with a backing pad or disc. The backing system is typically made of hard plastic, phenolic resin, or medium-hard rubber depending on the amount of flexibility desired. Disc grinders are standard equipment in metal fabrication shops and on construction sites. They are also common in machine shops, along with die grinders and bench grinders.

Another form of a disc grinder includes concrete saws, which are power tools used for cutting concrete, mortar, masonry, brick, asphalt, tile, and other solid materials. There are many types ranging from small hand-held saws, chop-saw models, and larger walk-behind saws or other styles, which also may be powered by gasoline, hydraulic or pneumatic pressure, or an electric motor. The saw blades used on concrete saws are often diamond saw blades to cut concrete, mortar, asphalt, stone, and the like. Abrasive cut-off wheels can also be used on cut-off saws to cut stone and steel.

During construction, it is oftentimes necessary that concrete, stone or masonry be cut. This may be applicable to any form of construction wherein those materials are used, including, but not limited to, highway construction, bridge construction, and commercial and residential building construction. Generally, a hand-held disc grinder, or concrete saw, having a specialized, hardened, rotary blade is used to cut the concrete, stone or masonry. Further, concrete saws are often used to cut mortar joints, or the mortar which holds masonry units, including bricks and concrete cinder blocks, together. During this process, which includes the blade of the hand-held concrete saw to pulverize and turn to dust the concrete, mortar, stone or masonry, a cloud of dust and debris is created. This cloud of dust and debris may be harmful to the operator, or any other workers in close proximity, especially if inhaled. For example, the U.S. Occupational Safety and Health Administration has implemented regulations to contain and collect the debris created during the aforementioned cutting operations. This generally includes the use of a vacuum connected to the hand-held disc grinder so as to collect the debris created during the cutting of the concrete, stone or masonry.

There exist in the art several examples of devices that are attachable to hand-held disc grinders as a means to facilitate the collection of the dust and debris created during these operations. However, such prior art devices exhibit several shortcomings. For one, many are unable to completely evacuate all of the dust and debris, resulting in some of the dust and debris being jettisoned beyond the workable limits of any attached vacuum where it becomes airborne and a danger to workers. Further, many prior art devices are difficult to attach to the hand-held grinder, sometimes requiring more than one person to install. Finally, prior art devices do not offer an adequate means of removing all dust and debris via a vacuum hose attached thereto.

There therefore exists a need in the art to provide a device capable of collecting all dust and debris created during the concrete cutting process, that is easy to install, and that can be easily attached to the vacuum hose.

BRIEF SUMMARY OF INVENTION

A dust and debris removal assembly in accordance with the present invention includes a base portion attachable to a gear case of a disc grinder. The base portion comprises a member defining a major surface, a wall extending at least partially along an outer periphery of the major surface, an exhaust port contained within the wall, and a first ledge positioned proximate the exhaust port extending along the major surface.

In a first embodiment, a top plate removably attaches to the wall by means of inserting the plate into an annulus contained within the wall. In a second embodiment, the top plate is constructed integral with the base portion. In either embodiment, the top plate and the major surface of the base portion are substantially parallel to one another. The top plate includes a lip extending downward from a lateral edge toward the base portion. The first ledge and the lip are configured to permit a circular disc or blade attached to an arbor of the disc grinder to travel therebetween, with each positioned in close proximity to the blade. The base portion and the top plate are configured such that at least a portion of the circular disc is exposed to perform work on a substrate surface, the substrate surface including, but not limited to, cement, mortar, masonry, brick, metal or like material.

The base portion further includes a compartment in fluid communication with the exhaust port, the compartment defined by the first ledge, the wall, and a floor configured with the base portion. The floor is preferably seated at a depth lower than that of the major surface. When the top pate is attached to the base portion, the top plate does not fully extend over the compartment, which remains uncovered. A conduit, for connecting a vacuum hose to the assembly, extends from the wall in fluid communication with the exhaust port, wherein a horizontal axis of each of the first ledge and the lip extends approximately parallel with a central axis in which the conduit extends from exhaust port.

BRIEF DESCRIPTION OF THE DRAWINGS

The following figures are used herein in conjunction with the specification to assist in understanding the invention. The Figures are as follows.

DESCRIPTION OF THE INVENTION

Figure 1:
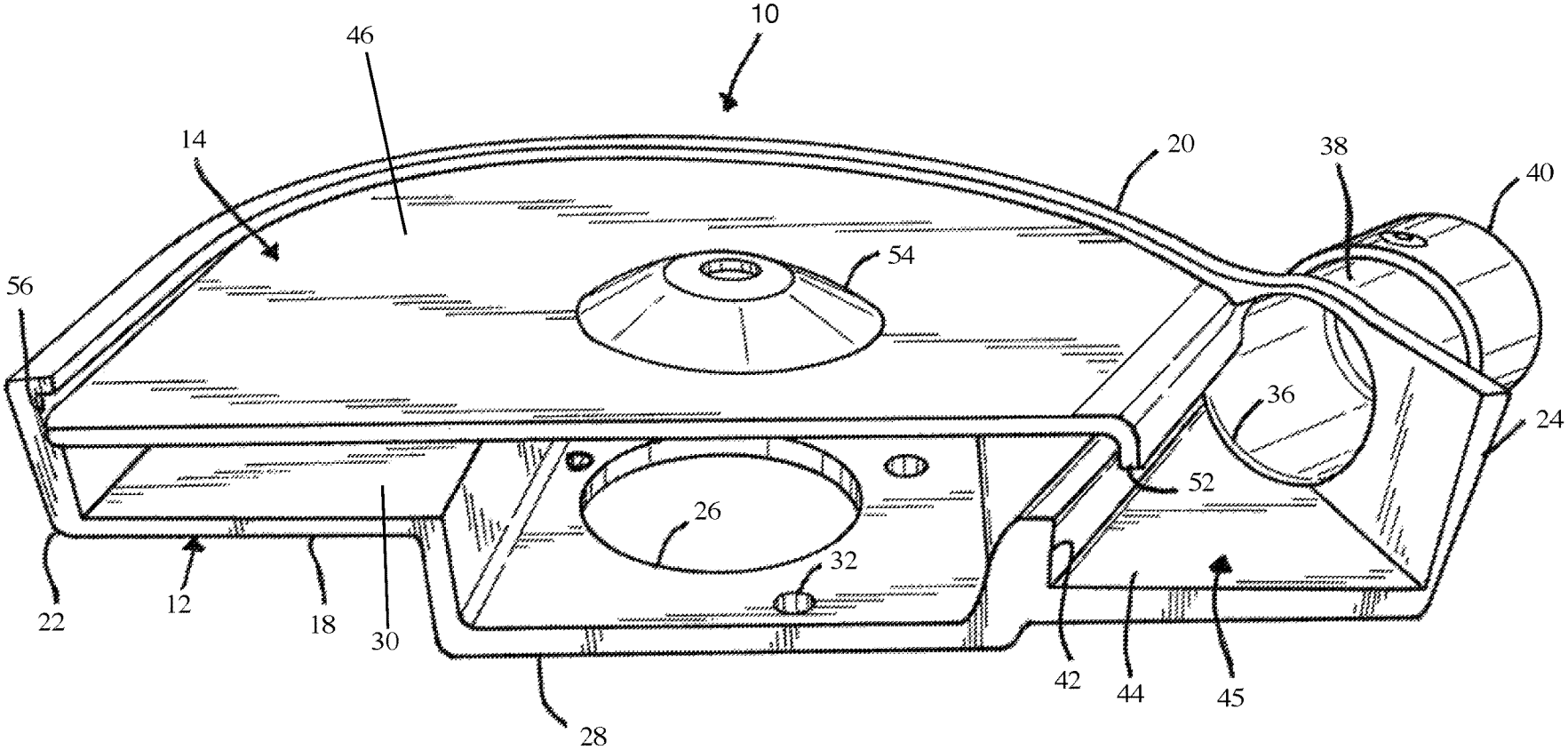
FIG. 1 is a perspective view of a debris removal assembly in accordance with the present invention.

Referring to FIG. 1, a dust and debris removal assembly in accordance with the present invention is generally indicated at 10. The dust removal assembly 10 generally includes a base portion 12 with a removably attachable top plate 12. However, in a second embodiment, the top plate 14 is constructed integral with the base portion 12. Preferably, both the base portion 10 and the top plate 12 are constructed from a lightweight metal, including either iron or aluminum. However, it is well within the scope of the present invention to construct the base portion 10 or top plate 12 from any durable material including, but not limited to, plastics, polymers or carbon fiber.

Figure 2:
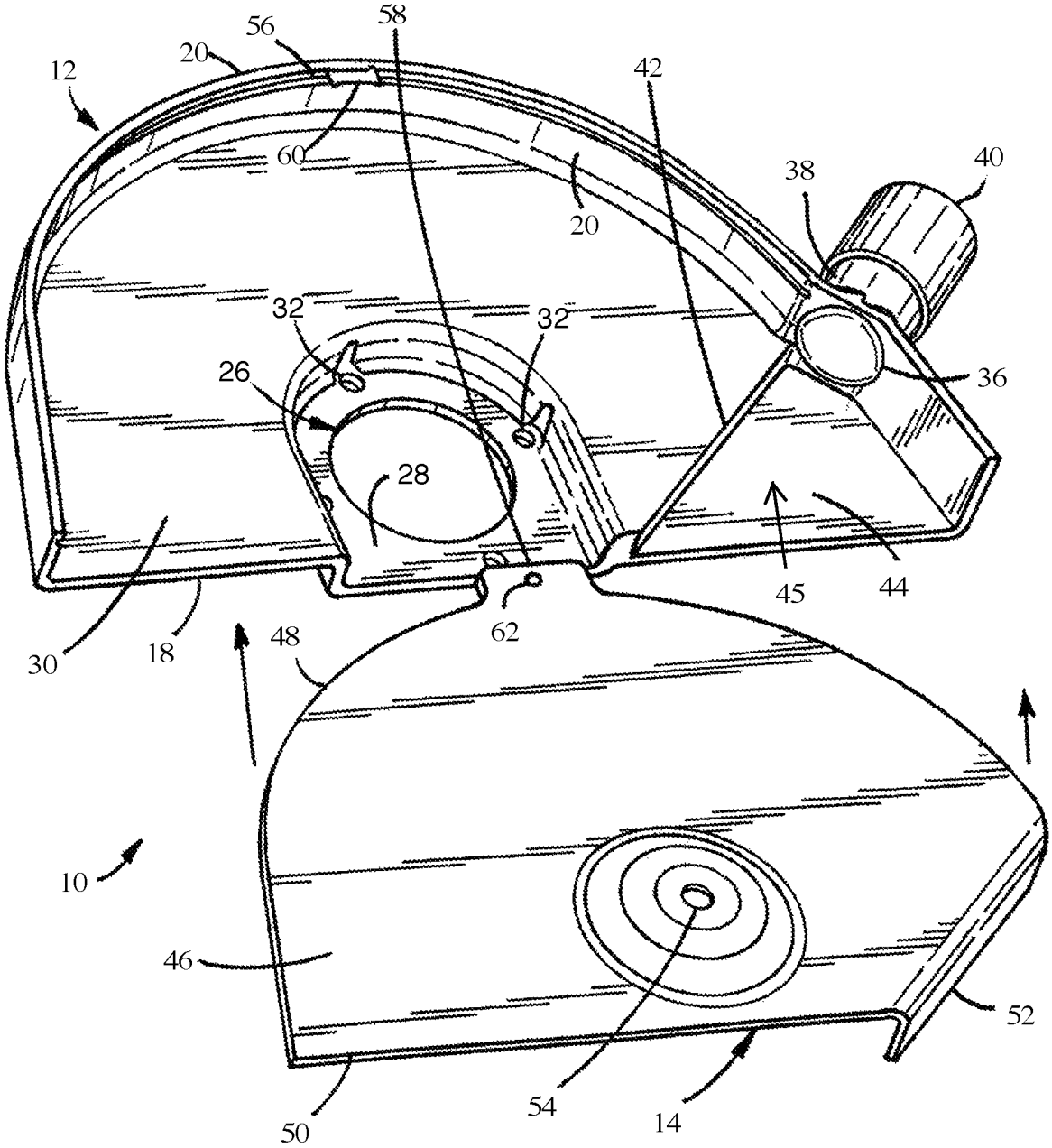
FIG. 2 is a top perspective view of the debris removal assembly in accordance with the present invention.
Figure 3:
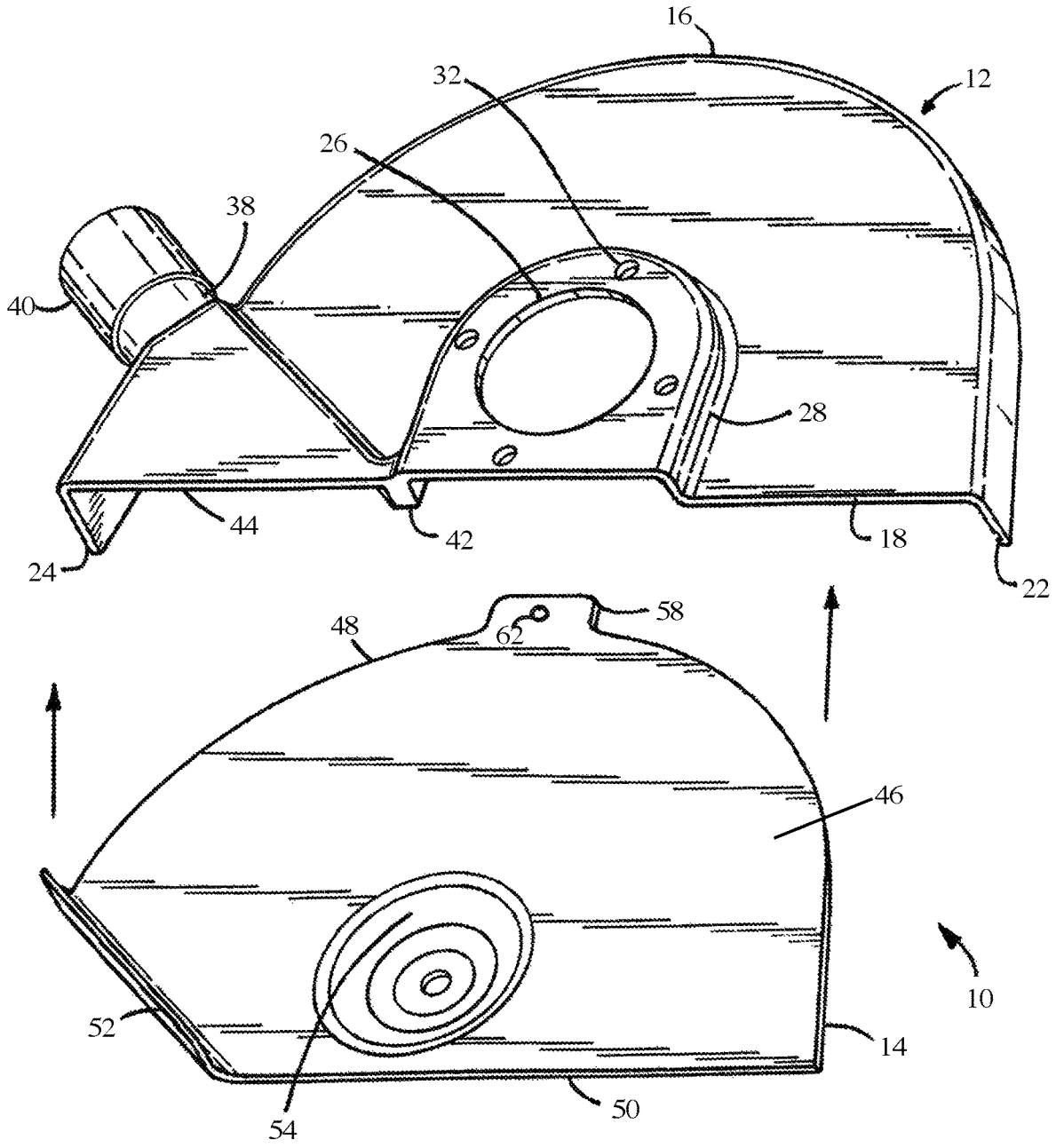
FIG. 3 is a bottom perspective view of the debris removal assembly in accordance with the present invention.

As best illustrated in FIGS. 2 and 3, the base portion 12 includes a substantially semi-circular outer perimeter 16 connected by a straight edge or end 18. By substantially semi-circular, it is meant a portion having a constant arc of curvature for at least 90 degrees, and that other portions beyond that arc may be straight or of varied arc of curvature. The semi-circular portion 16 includes a wall 20 extending therefrom, wherein the opposing ends 22, 24 are at the terminus of the straight edge 18. The wall 20 is generally concentric to a central aperture 26 contained within a mount 28, about which a first major flat surface 30 extends. The mount 28 is inlet from the first major surface 30, thereby permitting the base portion 12 to be positioned about the arbor 74 of a disc grinder 70. Connecting apertures 32 positioned within the mount 28 about the central aperture 26 permit the base portion 12 to be attached to a gear case 34 of the disc grinder 70 by bolts. For purposes of this description, a disc grinder 70 is generally meant to include a wide variety of tools known in the art that employ the rotation of an abrasion disc or cutting blade, including, but not limited to, power hand tools such as disc grinders, side grinders, angle grinders and concrete saws, as well as chop-saw models and larger walk-behind saws, any of which may be powered by gasoline, hydraulic or pneumatic pressure, or an electric motor.

Figure 4:
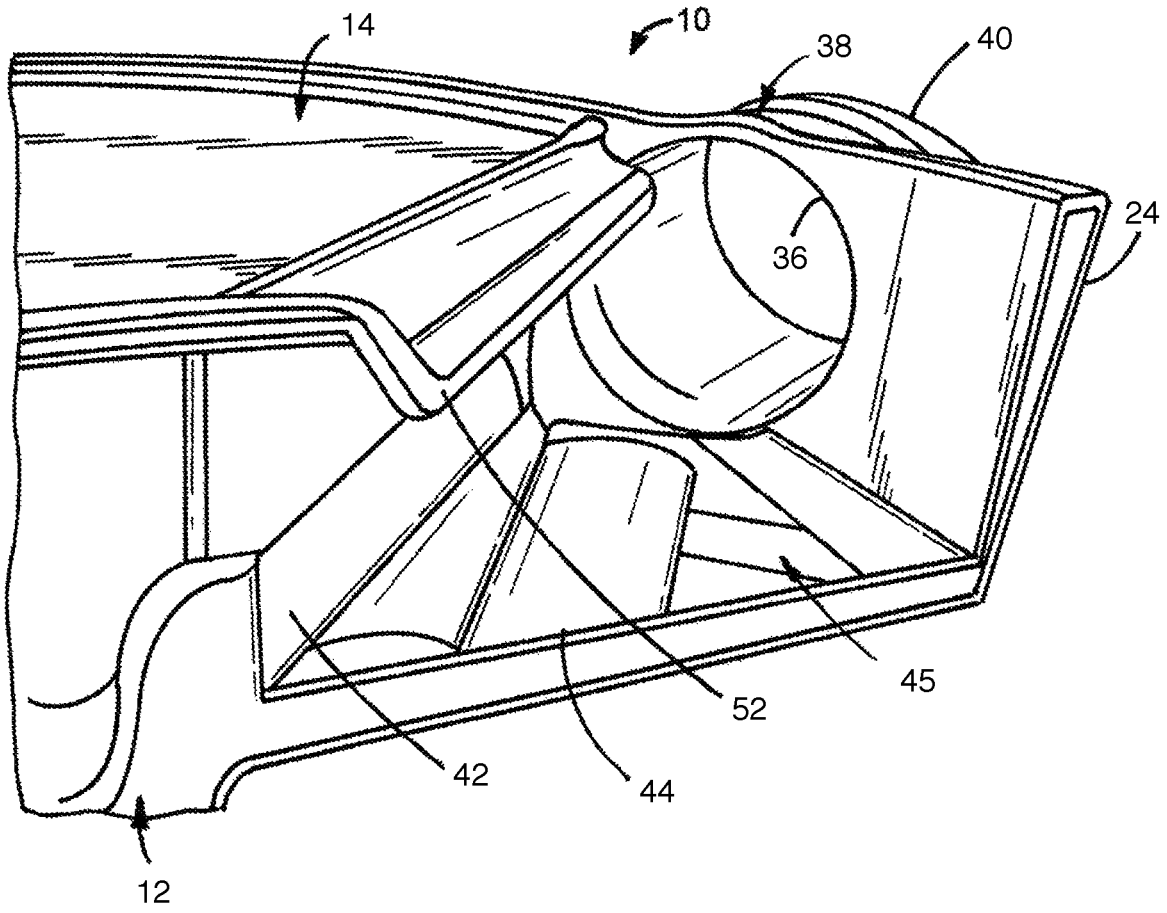
FIG. 4 is an enlarged perspective view of a compartment of the debris removal assembly in accordance with the present invention.

The wall 20 further contains an exhaust port 36, to which is attached a conduit 38 extending outward from the wall 20 along central axis 39. Attached to the conduit 38 is a hose connector 40 preferably containing threading, preferably left-handed, for threadably connecting a vacuum hose (not shown) connected to a vacuum (not shown) for removing dust and debris, as is known in the art. A ledge 42 extends along the major surface 30 between an area proximate the exhaust port 36 to an edge of the mount 28. As best illustrated in FIG. 4, the ledge 42, along with the wall 20 and a second minor surface or floor 44, define a region or compartment 45 separated from the major surface 30. In preferred embodiments, the second minor surface 44 of compartment 45 lies at a depth below the first major surface 30. The depth of the second minor surface 44 coincides with the lower extremity of the exhaust port 36 contained within the wall 20, however, providing a greater depth is well within the scope of the present invention.

Figure 5:
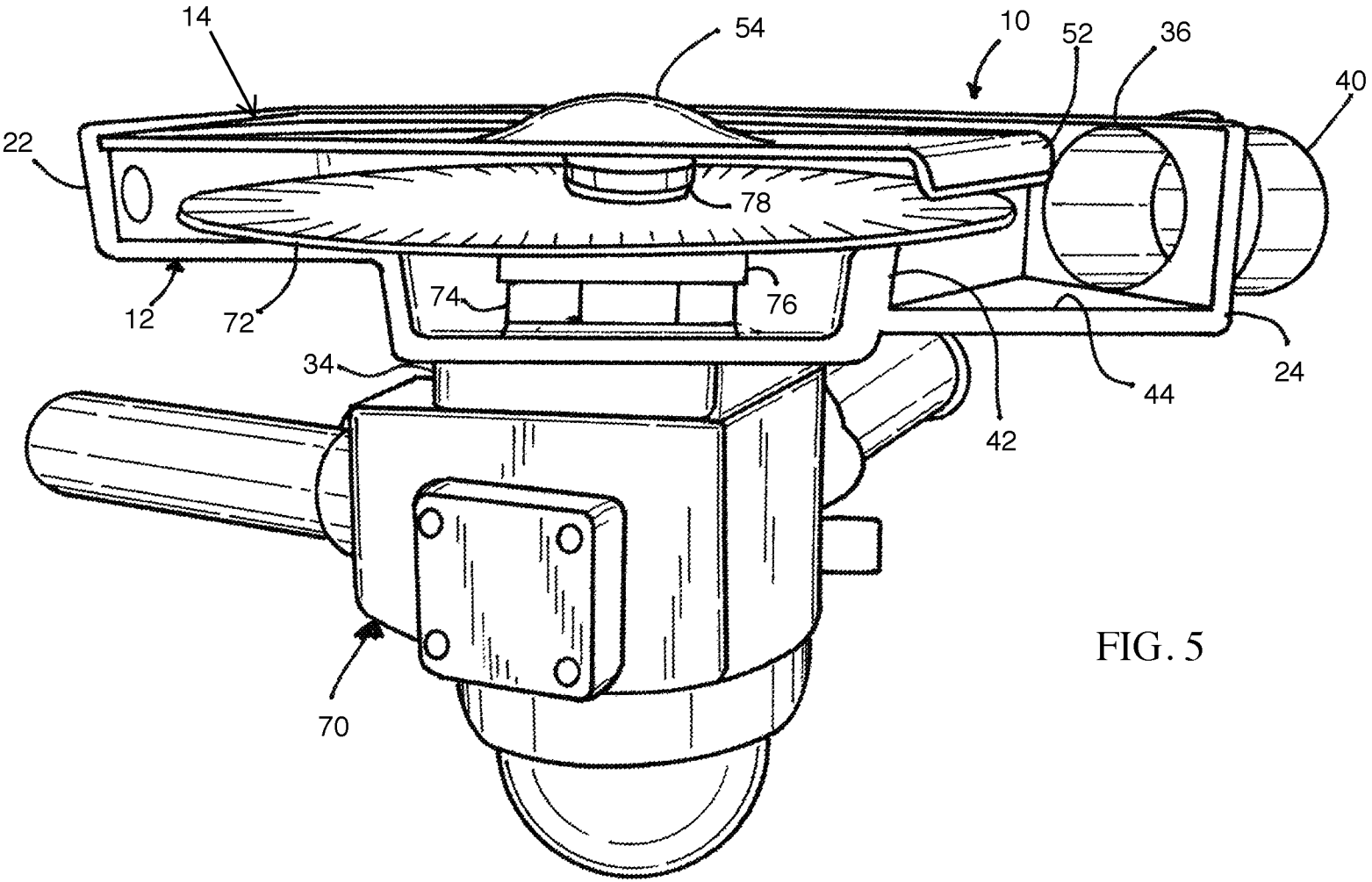
FIG. 5 is a side perspective view of the debris removal assembly in accordance with the present invention as used in conjunction with a disc grinder.

Referring back to FIGS. 1 through 3, the assembly 10 also includes the top plate member 14. The plate member 14 is generally constructed to mate with the base portion 12, and thereby has a similar geometry to that of the base 12. In a preferred embodiment, the top plate 14 is removably attachable to the base portion 12. However, it is well within the scope of the present invention to provide the top plate 14 as a single construction, integrally formed with the base portion 12. The plate member 14 includes a generally flat major surface 46 having a rounded edge 48, a straight end 50, and a downwardly extending lip or ledge 52. Terminal ends of the downwardly extending lip 52 connect the rounded edge 48 with straight edge 50. An outwardly extending, centrally positioned dome 54 shrouds about a nut 78 which is used to attach disc 72 to arbor 74 with spacer 76, as illustrated in FIG. 5. The rounded end 48 of the top plate 14 is substantially semi-circular, similar to that of the base portion 12. In the preferred embodiment, to attach the top plate 14 to the base portion 12, the exterior perimeter of the plate member 48 is disposable within an annulus 56 contained along an inner perimeter of the wall 20. A tab 58 extending from the rounded end of the plate member 14 is disposable within a slot 60 contained within a corresponding portion of the annulus 56 and wall 20. The plate member 14 can be locked into position by inserting a key or pin (not shown) through an aperture 62 contained within the tab 58, thus preventing lateral movement of the plate member 14 once inserted, thereby preventing the plate member 14 from disengaging from the base portion 12. Alternatively, and especially in consideration of relatively large disc grinders, where it may be difficult to attach the top plate as a separate piece, it is well within the scope of the present invention to provide the base portion and top plate as a single, integral cast unit, wherein the top plate is not removable.

With the plate member 14 connected to the base 12, the lip 52 and ledge 42 are positioned parallel to one another. The lip 52 may be positioned generally offset to the ridge or ledge 42 contained within the base 12, of which the lip or ledge 52 of the top plate 14 is positioned a slight distance more towards the exhaust port 36 than the ledge 42 of the base portion 12, as illustrated in FIGS. 1 and 4. However, it is well within the scope of the present invention to provide lip 52 immediately adjacent and in vertical alignment with the ledge 42. In either embodiment, it is advantageous that both ledge 42 and lip 52 are positioned as close to blade 72 as possible, while still permitting rotation of blade 72. As some applications may call for the use of more than one blade, the present invention contemplates alternative top plates 46 with lips 52 downwardly extending at differing depths, which may be employed to provide the appropriate fit.

The compartment 45 in the base portion 12, positioned beyond the ridge 42 and ledge 52, is generally uncovered by the plate member 14, and therefore open to the atmosphere. Immediately adjacent, and in fluid communication with this compartment 45, is the exhaust port 36 to which the vacuum hose (not shown) can be connected via the conduit 38 and connector 40. This region 45 permits dust and particles created during use of the disc grinder 70 to be jettisoned toward the exhaust port 36 where the attached vacuum removes the same. Not wanting to be bound by theory, it is believed that the positioning of the canted lip 52 in relation to the ledge 42, in close proximity with the disc 72 which rotates therebetween, creates a low-pressure in the containment region of compartment 45, whereby the dust and particles created during operation are jettisoned with centripetal force and low pressure towards and through the exhaust port 36, thereby permitting the attached vacuum to remove the dust and particles with greater efficacy and efficiency. As such, the dust, particles and debris created during operation of the disc grinder 70 are thereby entirely taken in by the vacuum and not allowed to contaminate the surrounding area. To further facilitate this process, both the ledge 42 and lip 52 are preferably positioned substantially parallel to the central axis 39 of the conduit 38. By substantially parallel, it is meant that while it is preferable that the ledge 42 and lip 52 are aligned parallel to the central axis 39, such alignment may fluctuate by up to 30 degrees.

Figure 6:
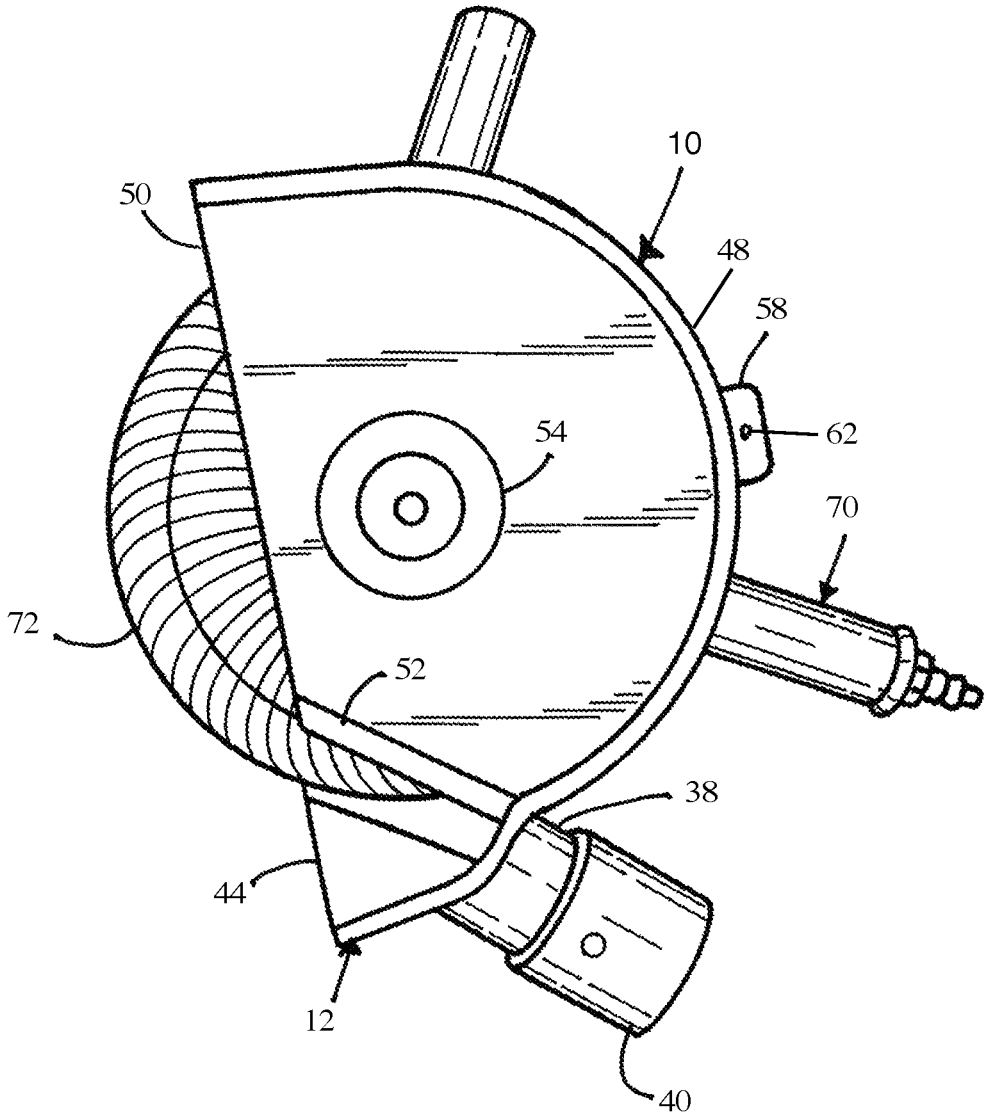
FIG. 6 is a top view of the debris removal assembly in accordance with the present invention as used in conjunction with a disc grinder.
Figure 7:
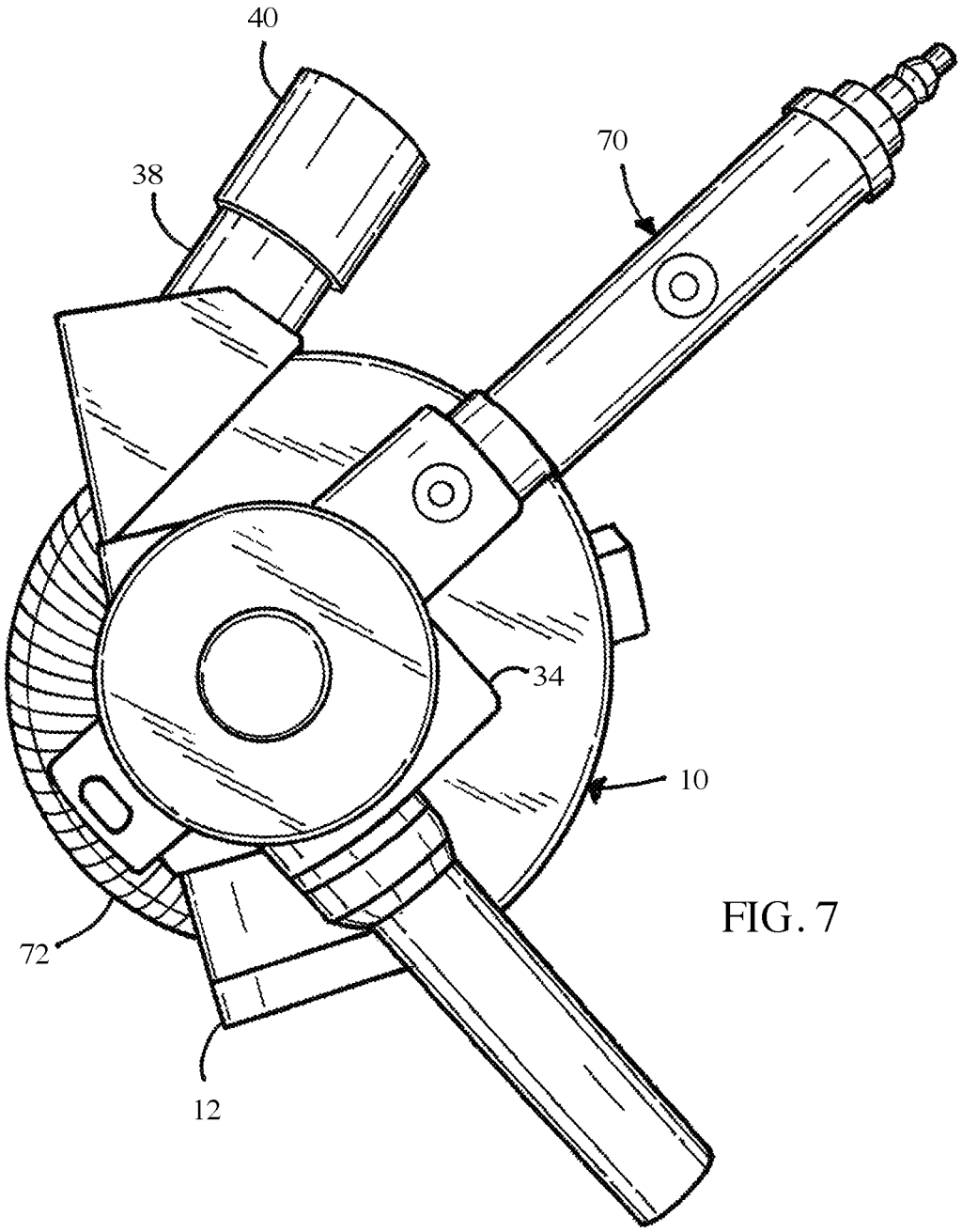
FIG. 7 is a bottom view of the debris removal assembly in accordance with the present invention as used in conjunction with a disc grinder.

As best illustrated in FIG. 5, a spacer 76 affixes to the arbor 74. A disc or blade 72 is positioned upon the pacer 76, whereupon a nut 78 secures the blade 72 in place, as is known in the art. Once attached to the disc grinder 70, and as best illustrated in FIGS. 6 and 7, a portion of the disc blade 72 is exposed in order that it may be used to contact a work piece or substrate surface in the manner as previously described herein. To change blades or discs 72, the top plate 14 is removed, thereby exposing the securing nut 78, which is then removed, allowing the disc or blade 72 to be replaced. Once replaced, the nut 78 is again screwed to the arbor 74 to secure the blade 72. The top plate 14 is then affixed to the base portion 12 in the manner as previously described herein.

It is recognized there are multiple variations beyond what are outlined in the detailed description to accomplish the objectives set forth by the current invention. Further alternative embodiments provide additional utility of the device for the convenience of the user. As such, although the present invention has been described with reference to preferred and alternative embodiments, workers skilled in the art will recognize that changes may be made in form and detail without departing from the spirit and scope of the invention.

The invention claimed is:

1. A dust and debris removal assembly for use with a disc grinder, the disc grinder having a gear case supporting a rotatable arbor with a circular disc attachable to the arbor, the assembly comprising:

a base portion attachable to the gear case of the disc grinder, the base portion having a semi-circular wall extending along an outer periphery, a centrally positioned aperture, the arbor of the disc grinder disposable through the aperture, and a first major surface;

a top plate having an outer perimeter engageable with the semi-circular wall of the base portion, the base portion and the top plate configured to accommodate the circular disc therebetween, wherein at least a portion of the circular disc is exposed to perform work on a substrate surface;

an exhaust port contained within the wall of the base portion;

a first ledge extending along the first major surface of the base portion positioned proximate the exhaust port; and a second ledge extending downwardly from the outer perimeter of the top plate toward the base portion, wherein the second ledge is positioned proximate the first ledge so as to permit the circular disc to travel therebetween.

2. The assembly of claim 1, and further comprising a compartment within the base portion in communication with the exhaust port, the compartment defined by the first ledge, the wall, and a minor surface positioned below the first major surface.

3. A dust and debris removal assembly for use with a disc grinder, the disc grinder having a gear case supporting a rotatable arbor with a circular disc attachable to the arbor, the assembly comprising:

a base portion attachable to the gear case of the disc grinder, the base portion having a semi-circular wall extending along an outer periphery, a centrally positioned aperture, the arbor of the disc grinder disposable through the aperture, and a first major surface;

a top plate connected to the wall of the base portion, the base portion and the top plate configured to accommodate the circular disc therebetween, wherein at least a portion of the circular disc is exposed to perform work on a substrate surface;

an exhaust port contained within the wall of the base portion;

a first ledge extending along the first major surface of the base portion positioned proximate the exhaust port; and a second ledge extending downwardly from the top plate toward the base portion, wherein the second ledge is positioned proximate the first ledge so as to permit the circular disc to travel therebetween, wherein each the first ledge and the second ledge extend horizontally along an axis parallel to one another.

4. A dust and debris removal assembly for use with a disc grinder, the disc grinder having a gear case supporting a rotatable arbor with a circular disc attachable to the arbor, the assembly comprising:

a base portion attachable to the gear case of the disc grinder, the base portion having a semi-circular wall extending along an outer periphery, a centrally positioned aperture, the arbor of the disc grinder disposable through the aperture, and a first major surface;

a top plate connected to the wall of the base portion, the base portion and the top plate configured to accommodate the circular disc therebetween, wherein at least a portion of the circular disc is exposed to perform work on a substrate surface;

an exhaust port contained within the wall of the base portion;

a first ledge extending along the first major surface of the base portion positioned proximate the exhaust port; and a second ledge extending downwardly from the top plate toward the base portion, wherein the second ledge is positioned proximate the first ledge so as to permit the circular disc to travel therebetween, wherein the wall contains an annulus positioned along a distal end, the annulus for receiving the top plate to the base portion, wherein positioning the top plate to dispose a peripheral edge within the annulus, the top plate attaches to the base portion.

5. The assembly of claim 4, and further comprising:

a slot contained in the annulus; and a tab extending from the peripheral edge of the top plate, wherein the slot is configured to receive the tab, wherein upon inserting the tab within the slot, the top plate is secured to the base portion.

6. A dust and debris removal assembly for use with a disc grinder, the disc grinder having a gear case supporting a rotatable arbor with a circular disc attachable to the arbor, the assembly comprising:

a base portion attachable to the gear case of the disc grinder, the base portion having a semi-circular wall extending along an outer periphery, a centrally positioned aperture, the arbor of the disc grinder disposable through the aperture, and a first major surface;

a top plate connected to the wall of the base portion, the base portion and the top plate configured to accommodate the circular disc therebetween, wherein at least a portion of the circular disc is exposed to perform work on a substrate surface;

an exhaust port contained within the wall of the base portion;

a first ledge extending along the first major surface of the base portion positioned proximate the exhaust port;

a second ledge extending downwardly from the top plate toward the base portion, wherein the second ledge is positioned proximate the first ledge so as to permit the circular disc to travel therebetween; and a conduit extending from the wall in fluid communication with the exhaust port, wherein a horizontal axis of each of the first ledge and the second ledge extends substantially parallel with a central axis in which the conduit extends.

7. The assembly of claim 6, wherein the central axis extends tangential to the circular disc.

8. A dust and debris removal assembly for use with a disc grinder, the disc grinder having a gear case supporting a rotatable arbor with a circular disc attachable to the arbor, the assembly comprising:

a base portion attachable to the gear case of the disc grinder, the base portion comprising:

a member defining a major surface;

a wall extending at least partially along an outer periphery of the major surface, an exhaust port contained within the wall; and a first ledge positioned proximate the exhaust port extending along the major surface; and a top plate attachable to the wall of the base portion, the top plate and the major surface of the base portion being substantially parallel to one another when the top plate is attached to the wall, the top plate including a second ledge extending downward from a lateral edge toward the base portion, wherein the first ledge and the second ledge extend horizontally parallel to one another, wherein the first ledge and the second ledge are configured to permit the circular disc to travel therebetween, wherein at least a portion of the circular disc is exposed to perform work on a substrate.

9. The assembly of claim 8, and further comprising a compartment within the base portion in communication with the exhaust port, the compartment defined by the first ledge, the wall, and a minor surface seated below the major surface, the compartment open to the atmosphere.

10. The assembly of claim 8, wherein the wall contains an annulus positioned along a distal end, the annulus for receiving the top plate, wherein positioning the top plate to dispose a peripheral edge within the annulus, the top plate attaches to the base portion.

11. The assembly of claim 10, and further comprising:

a slot contained in the annulus; and a tab extending from the peripheral edge of the top plate, wherein the slot is configured to receive the tab, wherein upon inserting the tab within the slot, the top plate is secured to the base portion.

12. The assembly of claim 8, and further comprising a conduit extending from the wall in fluid communication with the exhaust port, wherein a horizontal axis of each of the first ledge and the second ledge extends substantially parallel with a central axis in which the conduit extends.

13. The assembly of claim 12, wherein the central axis extends tangential to the circular disc.

14. A dust and debris removal assembly for use with a disc grinder, the disc grinder having a gear case supporting a rotatable arbor with a circular disc attachable to the arbor, the assembly comprising:

a base portion attachable to the gear case of the disc grinder, the base portion comprising:

a member defining a major surface;

a wall extending at least partially along an outer periphery of the major surface;

an exhaust port contained within the wall;

a first ledge positioned proximate the exhaust port extending along the major surface; and a compartment in communication with the exhaust port, the compartment defined by the first ledge, the wall, and a minor surface positioned below the major surface;

a top plate connected to the wall of the base portion, the top plate and the major surface of the base portion being substantially parallel to one another, the top plate including a lip extending downward from a lateral edge toward the base portion, wherein the first ledge and the lip extend horizontally parallel to one another, wherein the first ledge and the lip are configured to permit the circular disc to travel therebetween, wherein at least a portion of the circular disc is exposed to perform work on a substrate;

a conduit extending from the wall in fluid communication with the exhaust port, wherein the horizontal axis of each of the first ledge and the second ledge extends parallel with a central axis in which the conduit extends.

15. The assembly of claim 14, wherein the central axis extends tangential to the circular disc.

16. The assembly of claim 14, wherein the base portion further includes an annulus positioned along a distal end of the wall, the annulus for receiving a peripheral edge of the top plate, wherein positioning the top plate to dispose a peripheral edge within the annulus, the top plate attaches to the base portion.

17. The assembly of claim 16, and further comprising:

a slot contained in the annulus; and a tab extending from the peripheral edge of the top plate, wherein the slot is configured to receive the tab, wherein upon inserting the tab within the slot, the top plate is secured to the base portion.

18. The assembly of claim 3, and further comprising a compartment within the base portion in communication with the exhaust port, the compartment defined by the first ledge, the wall, and a minor surface positioned below the first major surface.

19. The assembly of claim 4, and further comprising a compartment within the base portion in communication with the exhaust port, the compartment defined by the first ledge, the wall, and a minor surface positioned below the first major surface.

20. The assembly of claim 6, and further comprising a compartment within the base portion in communication with the exhaust port, the compartment defined by the first ledge, the wall, and a minor surface positioned below the first major surface.

* * * * *